US008414350B2

(12) United States Patent
Rehkemper et al.

(10) Patent No.: US 8,414,350 B2
(45) Date of Patent: Apr. 9, 2013

(54) FIGURE WITH CONTROLLED MOTORIZED MOVEMENTS

(75) Inventors: Steven Rehkemper, Chicago, IL (US); Ryan Kratz, Oak Park, IL (US); Dennis O'Patka, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 572 days.

(21) Appl. No.: 12/543,124

(22) Filed: Aug. 18, 2009

(65) Prior Publication Data

US 2010/0151767 A1 Jun. 17, 2010

Related U.S. Application Data

(60) Provisional application No. 61/089,622, filed on Aug. 18, 2008.

(51) Int. Cl.
*A63H 3/20* (2006.01)
*A63H 11/00* (2006.01)
*A63H 13/00* (2006.01)

(52) U.S. Cl. ..... 446/330; 446/356; 446/353; 446/375; 446/376

(58) Field of Classification Search ..... 446/330, 446/396, 268, 376, 373, 375, 370, 371, 352, 446/353, 354, 356, 391, 390, 324; 318/568.2, 318/568.12, 568.11; 901/1; *A63H 3/20, A63H 11/00, 13/00*

See application file for complete search history.

(56) References Cited

U.S. PATENT DOCUMENTS

| | | | | | |
|---|---|---|---|---|---|
| 131,849 | A * | 10/1872 | Clay | 446/356 |
| 1,500,590 | A * | 7/1924 | Marx | 446/304 |
| 4,349,987 | A * | 9/1982 | Bart | 446/355 |
| 5,739,655 | A * | 4/1998 | Torii et al. | 318/568.12 |
| 5,842,533 | A * | 12/1998 | Takeuchi | 180/8.1 |
| 5,929,585 | A * | 7/1999 | Fujita | 318/568.2 |
| 5,963,712 | A * | 10/1999 | Fujita et al. | 700/264 |
| 6,095,887 | A * | 8/2000 | Llorens | 446/355 |
| 6,210,249 | B1 * | 4/2001 | Stadlbauer | 446/330 |
| 6,362,589 | B1 * | 3/2002 | Inoue et al. | 318/568.2 |
| 6,458,011 | B1 * | 10/2002 | Inoue et al. | 446/376 |
| 6,462,498 | B1 * | 10/2002 | Filo | 318/568.12 |
| 6,519,506 | B2 * | 2/2003 | Osawa | 700/245 |
| 6,534,943 | B1 * | 3/2003 | Hornby et al. | 318/568.12 |
| 6,591,923 | B2 * | 7/2003 | Inoue et al. | 180/8.1 |
| 6,667,593 | B2 * | 12/2003 | Inoue et al. | 318/568.2 |
| 6,672,935 | B1 * | 1/2004 | Lund et al. | 446/330 |
| 6,684,127 | B2 * | 1/2004 | Fujita et al. | 700/245 |
| 6,697,708 | B2 * | 2/2004 | Takagi et al. | 700/245 |
| 6,760,645 | B2 * | 7/2004 | Kaplan et al. | 700/245 |
| 6,952,629 | B2 * | 10/2005 | Takamura et al. | 700/259 |
| 7,062,356 | B2 * | 6/2006 | Takamura et al. | 700/259 |
| 7,063,591 | B2 * | 6/2006 | Furumura | 446/484 |

(Continued)

FOREIGN PATENT DOCUMENTS

| | | | |
|---|---|---|---|
| JP | 2001-2189985 | * | 8/2001 |
| JP | 2001-246584 | * | 9/2001 |

(Continued)

*Primary Examiner* — Gene Kim
*Assistant Examiner* — Matthew B Stanczak
(74) *Attorney, Agent, or Firm* — Adam K. Sacharoff

(57) ABSTRACT

A toy figure with controlled motorized movements is provided having a head, two arms two legs and a tail which are pivotally and/or rotatably attached to a chassis. Mechanisms and electronics are included to move the head, arms, legs and tail in a variety of play patterns and movements.

20 Claims, 15 Drawing Sheets

U.S. PATENT DOCUMENTS

| | | | | |
|---|---|---|---|---|
| 7,089,083 | B2 * | 8/2006 | Yokoo et al. | 700/245 |
| 7,762,863 | B1 * | 7/2010 | Lund et al. | 446/175 |
| 2001/0029147 | A1 * | 10/2001 | Hornsby et al. | 446/356 |
| 2002/0089297 | A1 * | 7/2002 | Filo | 318/568.12 |
| 2003/0097202 | A1 * | 5/2003 | Fujita et al. | 700/245 |
| 2004/0210347 | A1 * | 10/2004 | Sawada et al. | 700/246 |

FOREIGN PATENT DOCUMENTS

| | | | |
|---|---|---|---|
| JP | 2004-034169 | * | 2/2004 |
| JP | 2004-066381 | * | 3/2004 |
| JP | 2004-167627 | * | 6/2004 |
| JP | 2004-314216 | * | 11/2004 |

* cited by examiner

10

10

FIGURE WITH CONTROLLED MOTORIZED MOVEMENTS

CROSS REFERENCE TO RELATED APPLICATIONS

The present application claims priority to U.S. Provisional Application 61/089,622 filed Aug. 18, 2008 and titled "Figure with Controlled Motorized Movements."

FIELD OF THE INVENTION

The present invention relates to a figure with controlled motorized movements.

BACKGROUND OF THE INVENTION

There have been numerous varieties of children's toys that are non-interactive and interactive. A continual need for improvements in more realistic play qualities along with improved electronics and mechanics provide for new arrangements which improve or change the play and interaction between the child and the toy.

Numerous other advantages and features of the invention will become readily apparent from the following detailed description of the invention and the embodiments thereof and from the accompanying drawings.

SUMMARY OF THE INVENTION

In one or more embodiments of the present invention, a toy figure with controlled motorized movements is provided having a head, two arms and two legs. The head, two arms and two legs are pivotally and/or rotatably attached to a chassis. A first motor secured to the chassis and drives a tail mechanism attached to the chassis with a tail segment rotatably and pivotally attached to the tail mechanism. The tail mechanism also includes a tail linkage with forward and rearward linkage channels. The forward linkage channel is in communication with the inside rim of a tail cam, which is rotated by the first motor. As such, the movement of the forward linkage channel directs movement of the rearward linkage channel. The rearward linkage channel is in communication with a tail column that fits within the tail segment having a rearward projecting tail segment and a forward projecting segment pin. The forward projecting segment pin is positioned to move against an actuator having a cutout and a pair of flanges. The movement of the tail column moves the forward projecting segment pin against the pair of flanges to create a pivoting and rotating movement of the rearward projecting tail segment. Further, the pivoting and rotating movement of the rearward projecting tail segment may move along a figure eight pattern. An integrated circuit with electronics may be included to receive signals generated in response to a triggering means and for controlling movement of the tail mechanism in response to the signals.

Based thereon other aspects of the invention and other embodiments can be disclosed. For example, there may be provided an interactive toy figure with a chassis having rear and front sections with a pair of rear legs and a pair of front legs secured to respective sections. The chassis has a first substantially horizontal configuration with the rear and front legs being in communication with a surface and having a first front and rear leg configurations. A motor in communication with a mechanically operated means for raising and lowering the front section of the chassis is secured to the chassis. The motor may also move the rear section of the chassis upwardly and downwardly to cause a change in the center of gravity and define at least two configurations where at least one of the configurations is defined as a pouncing configuration. The mechanically operated means for lowering and raising the chassis in communication with a triggering means further includes an integrated circuit with electronics for receiving signals generated in response to the triggering means and for controlling movement of the mechanically operated means for lowering and raising the chassis.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
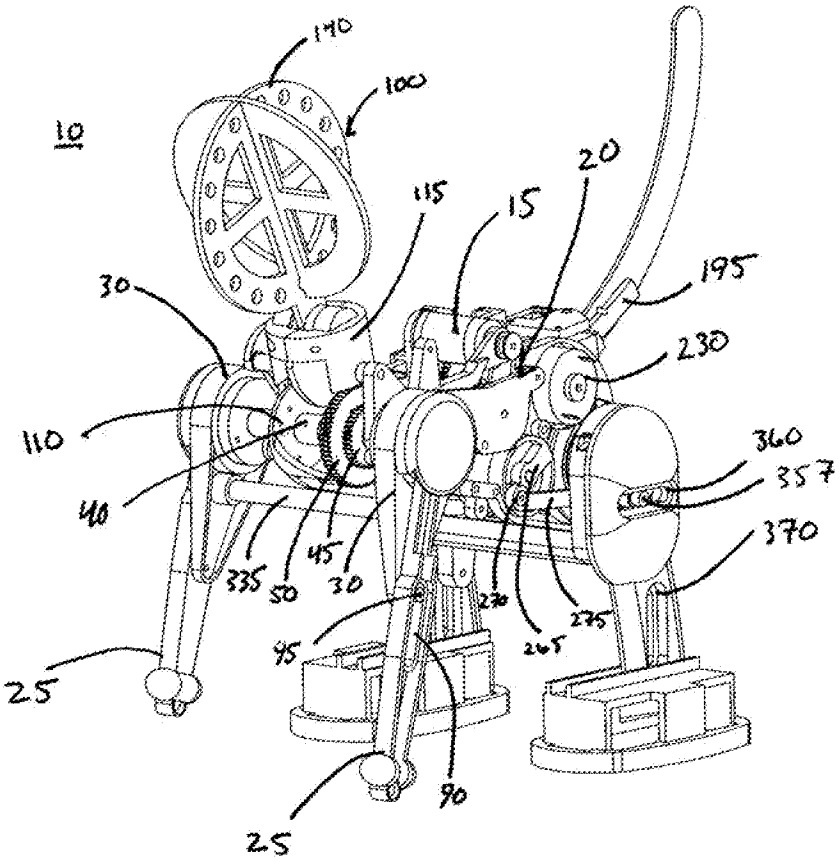
FIG. 1 is a front perspective view of a figure from the right in accordance with an embodiment of the present invention.
Figure 2:
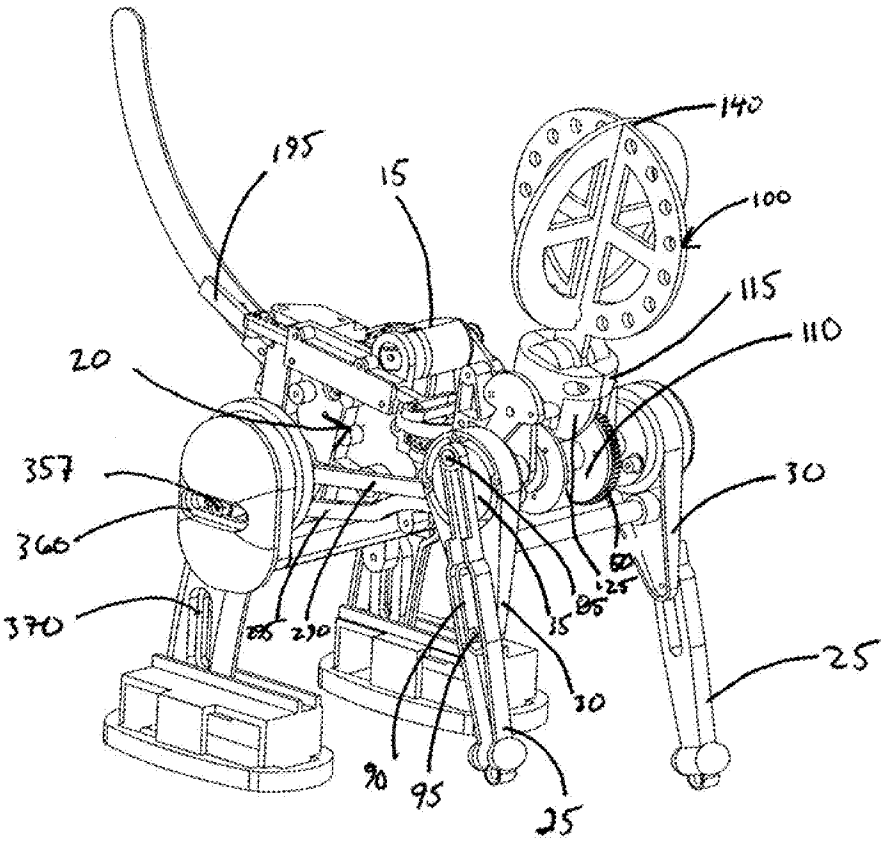
FIG. 2 is a front perspective view of the figure from FIG. 1 from the left in accordance with an embodiment of the present invention.
Figure 3A:
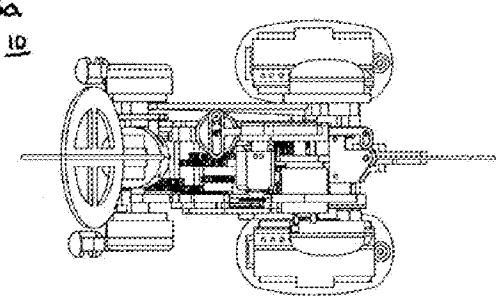
FIG. 3*a* is a top view of FIG. 1.
Figure 3C:
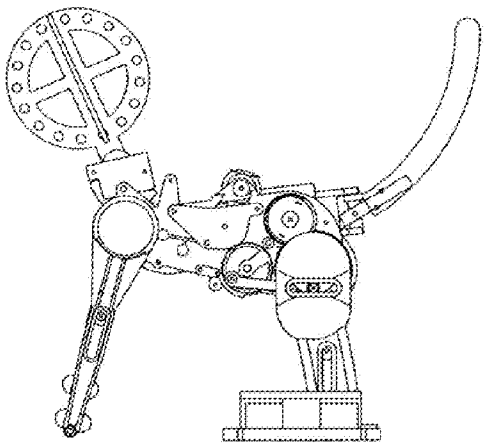
FIG. 3*c* is a side view of FIG. 1.
Figure 3E:
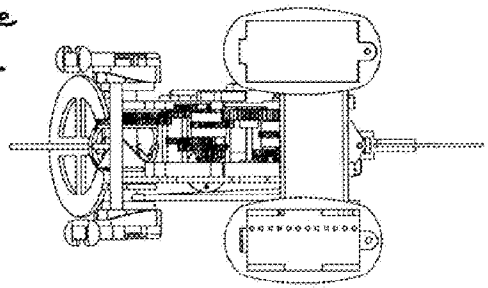
FIG. 3*e* is a bottom view of FIG. 1.
Figure 3B:
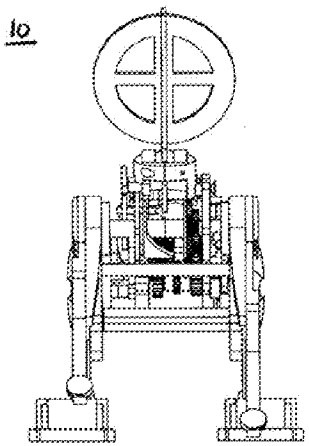
FIG. 3*b* is a front view of FIG. 1.
Figure 3D:
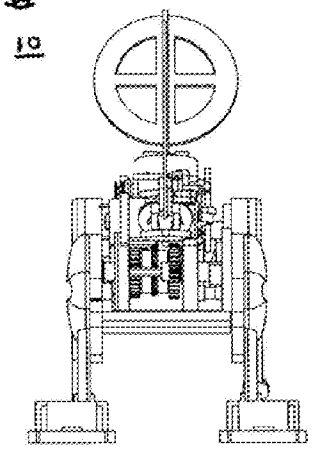
FIG. 3*d* is a rear view of FIG. 1.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention or the embodiments illustrated.

Referring now to FIGS. 1 through 3*e*, in accordance to an embodiment of the present invention, there is illustrated a FIG. 10 that includes a set of arm mechanisms, two head mechanisms, a tail mechanism and a chassis mechanism. In this embodiment, the FIG. 10 uses two motors to move the figure into and out of an assortment of movements and actions by varying the distribution and direction of power to the motors. A variety of external coverings (not shown) may be used for the FIG. 10, such as different types of animals or characters.

Figure 4:
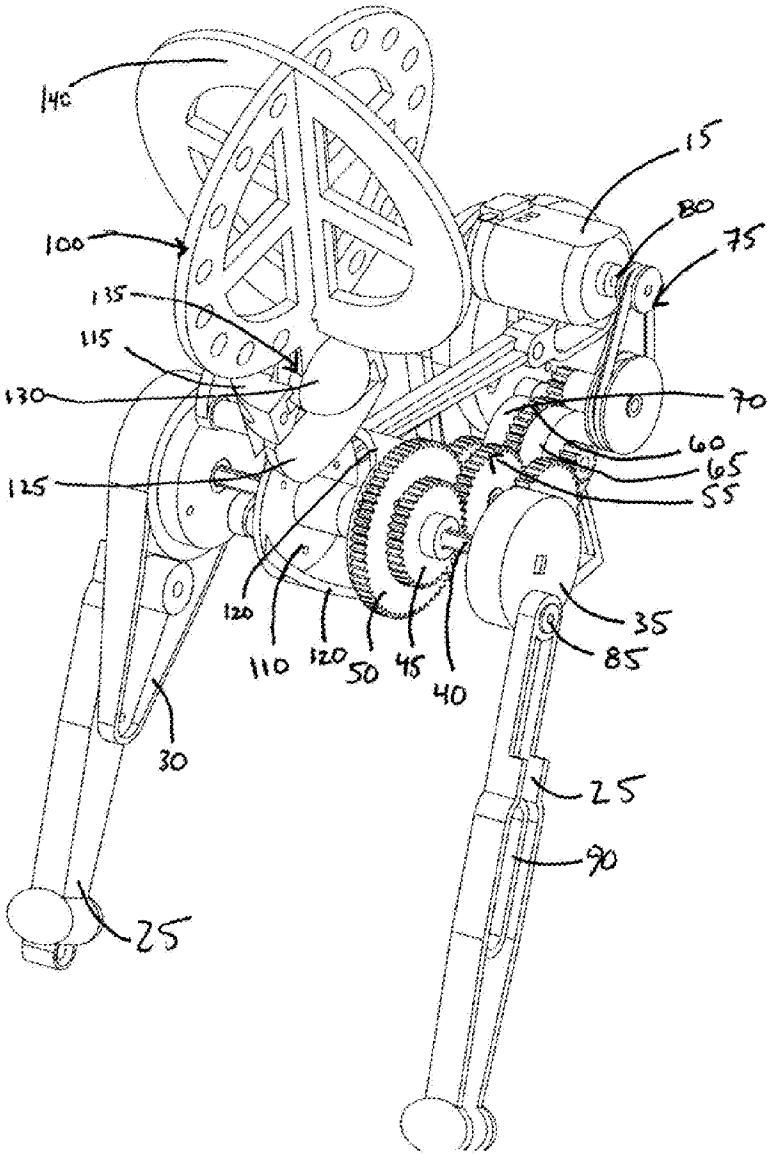
FIG. 4 is a perspective view of the figure from FIG. 1 in accordance with one embodiment of the present invention illustrating a partial view of an arm mechanism and a head mechanism.

Referring now also to FIG. 4, the FIG. 10 includes a set of arm mechanisms and a first head mechanism. Each arm mechanism includes an arm 25, a shoulder 30 and a shoulder cam 35. The arm mechanisms are further rotatably attached separately to either end of a front axle 40. An arm transfer gear 45 is fixedly attached to the front axle 40, such that the front axle 40 and arm transfer gear 45 rotate together. Additionally, a head transfer gear 50 is fixedly attached to the front axle 40, such that the head transfer gear rotates together with the front axle 40 and arm transfer gear 45. The arm transfer gear 45 and head transfer gear 50 are meshed to a gear train 55, which may be set at different ratios as desired. The gear train 55 is further meshed to a clutch gear 60 fixedly attached to a front clutch 65 and a tail clutch 70. The front clutch 65 is in meshed communication with a belt drive 75 that is driven by a first motor gear 80. The first motor gear 80 is driven by a first motor 15, which is secured to the chassis 20 (shown in FIG. 1). When the first motor 15 is powered in a clockwise direction, the front clutch 65 engages and transfers rotation, rotating the front axle 40. As the front axle 40 rotates, the shoulder cams 35 rotate accordingly.

A pin 85 is positioned on the outside of each shoulder cam 35 and at positions approximately 180 degrees different from each other. Varying degree positions may be used as desired. The upper portion of each arm 25 is rotatably attached to its respective pin 85. Each arm 25 also includes and aim channel 90 to receive a pin 95 positioned at the lower portion of each shoulder 30 to guide movement of the arms 25. When the shoulder cams 35 rotate, the arms 25 move up and down as the pin 95 slides along the arm channel 90. Positioning the pins 85 on the shoulder cams 35 at different degree points drives the arms 25 to move up and down opposite one another.

Figure 5:
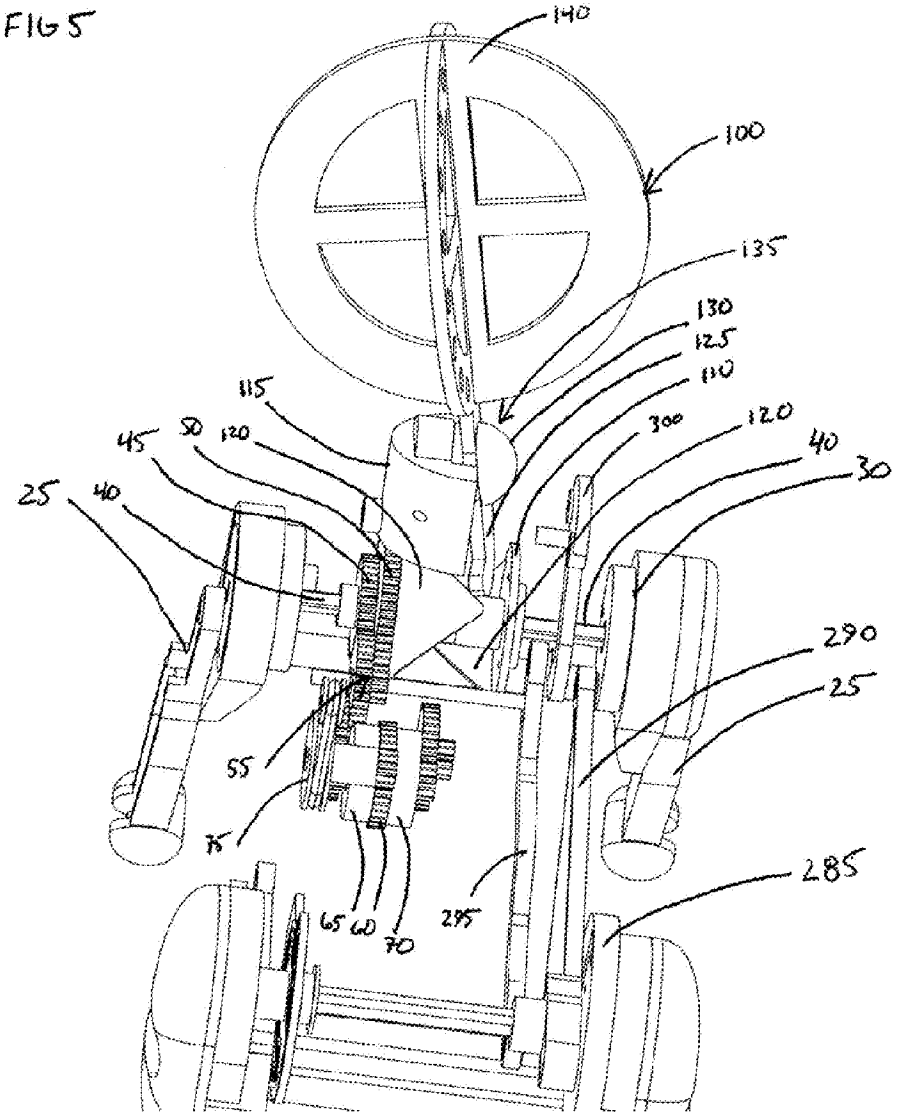
FIG. 5 is an enlarged rear perspective view of the figure from FIG. 1 in accordance with one embodiment of the present invention illustrating a partial view of the arm mechanism and head mechanism.

Continuing to refer to FIG. 4 and now additionally FIG. 5 the first head mechanism is illustrated. A head segment 100 moves simultaneously to the movement of the arm mechanisms described above. The first head mechanism includes the head transfer gear 50, a spool actuator 110, the head segment 100 and a neck housing 115. The spool actuator 110 has two triangularly shaped flanges 120 extending from the interior of each side and is fixedly attached to the head transfer gear 50. The head segment 100 includes a lower portion 125 that is pushed from side to side in a pendulum-type motion by the flanges 120 as the spool actuator 110 rotates. Further, the head segment 100 has a spherical shaped extrusion 130 at the mid section to create a ball joint 135 in combination with the neck housing 115. Thus, an upper portion 140 of the head segment 100 moves from side to side (and additionally in all directions) when the first motor 15 powers in the clockwise direction. The upper portion 140 may take on the form of a head for a variety of characters or animals, such as a cat.

Figure 6A:
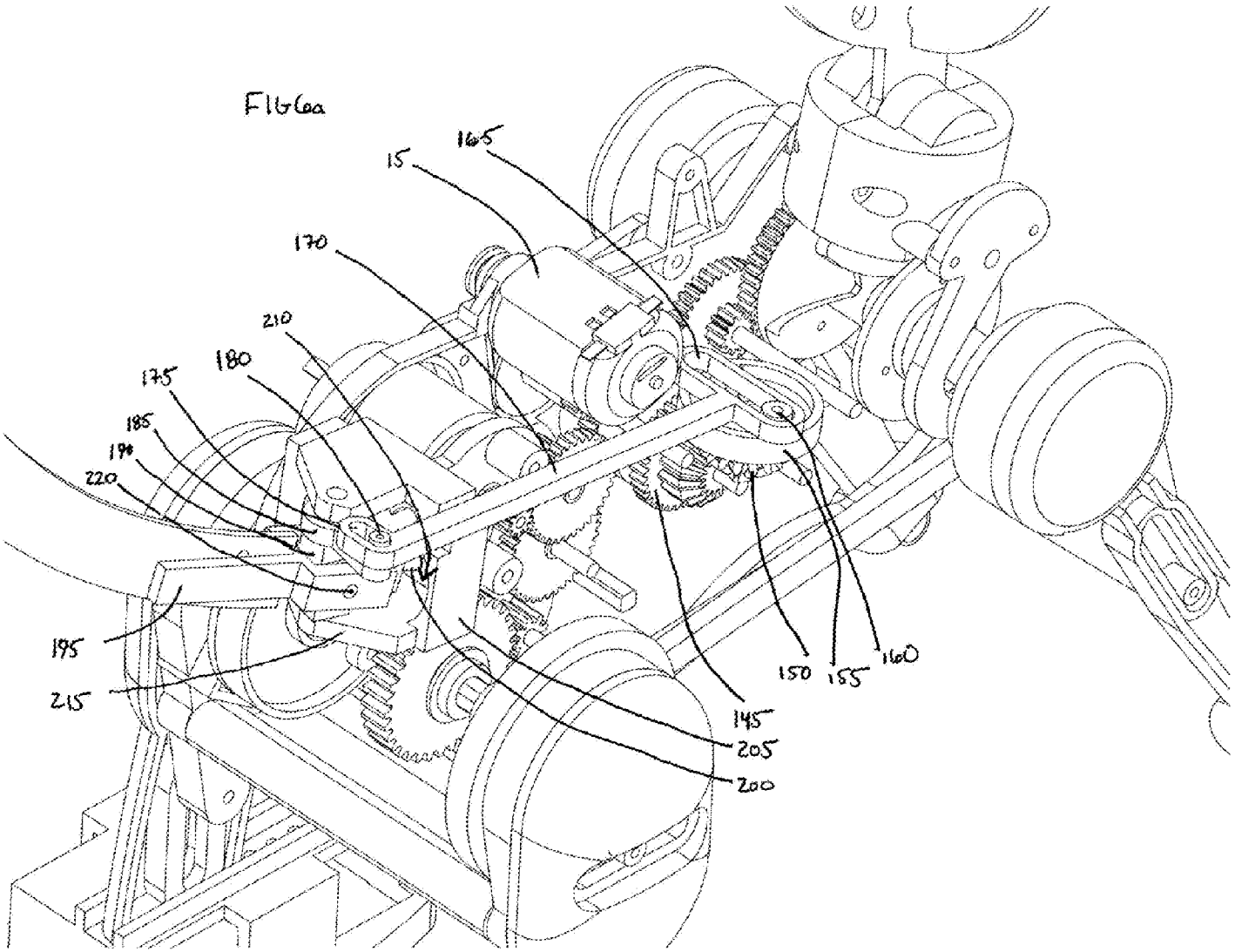
FIG. 6*a* is an enlarged rear perspective view of the figure from FIG. 1 in accordance with one embodiment of the present invention illustrating a view of a tail mechanism.
Figure 6B:
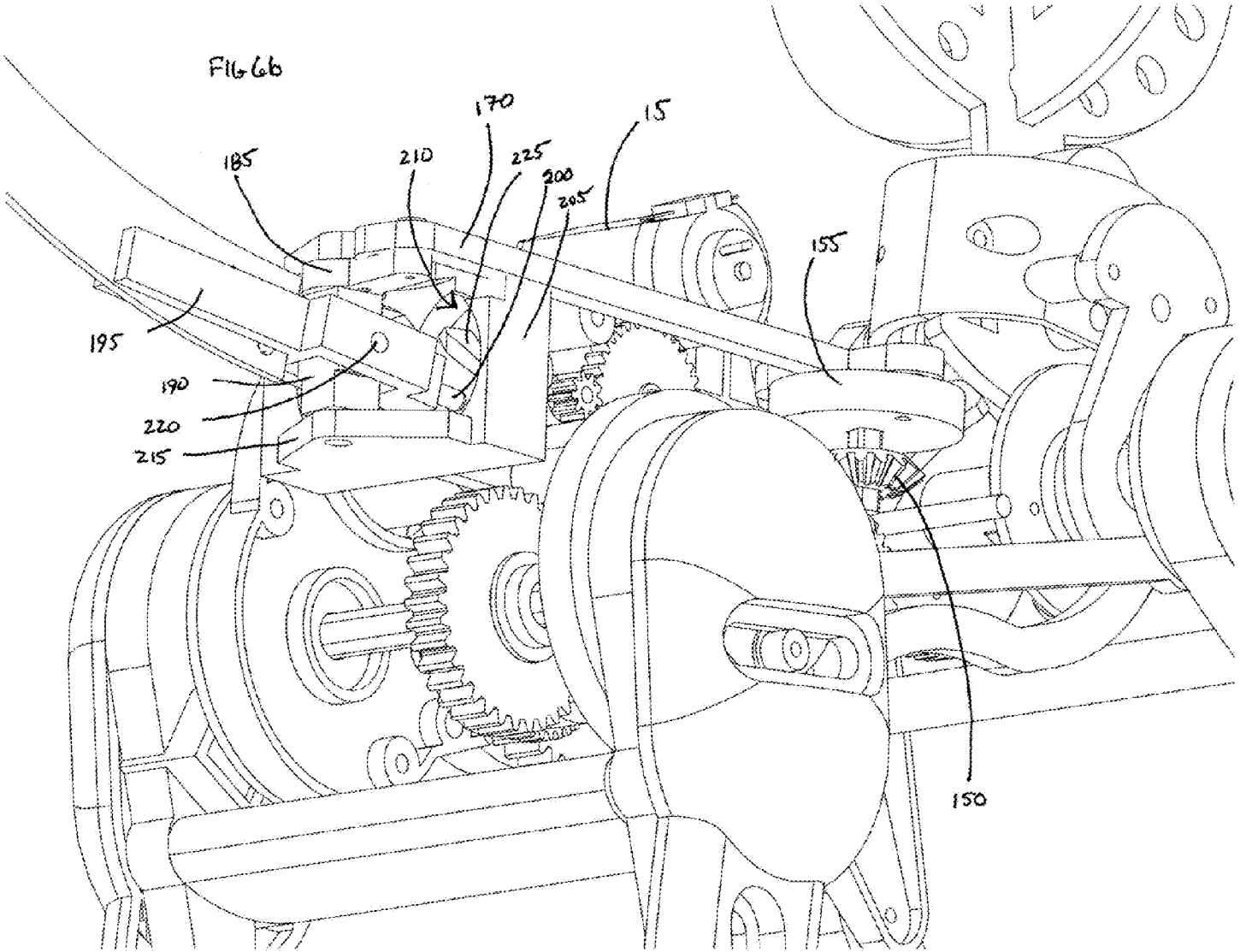
FIG. 6*b* is a perspective view of FIG. 6*a* from a lower angle.
Figure 6C:
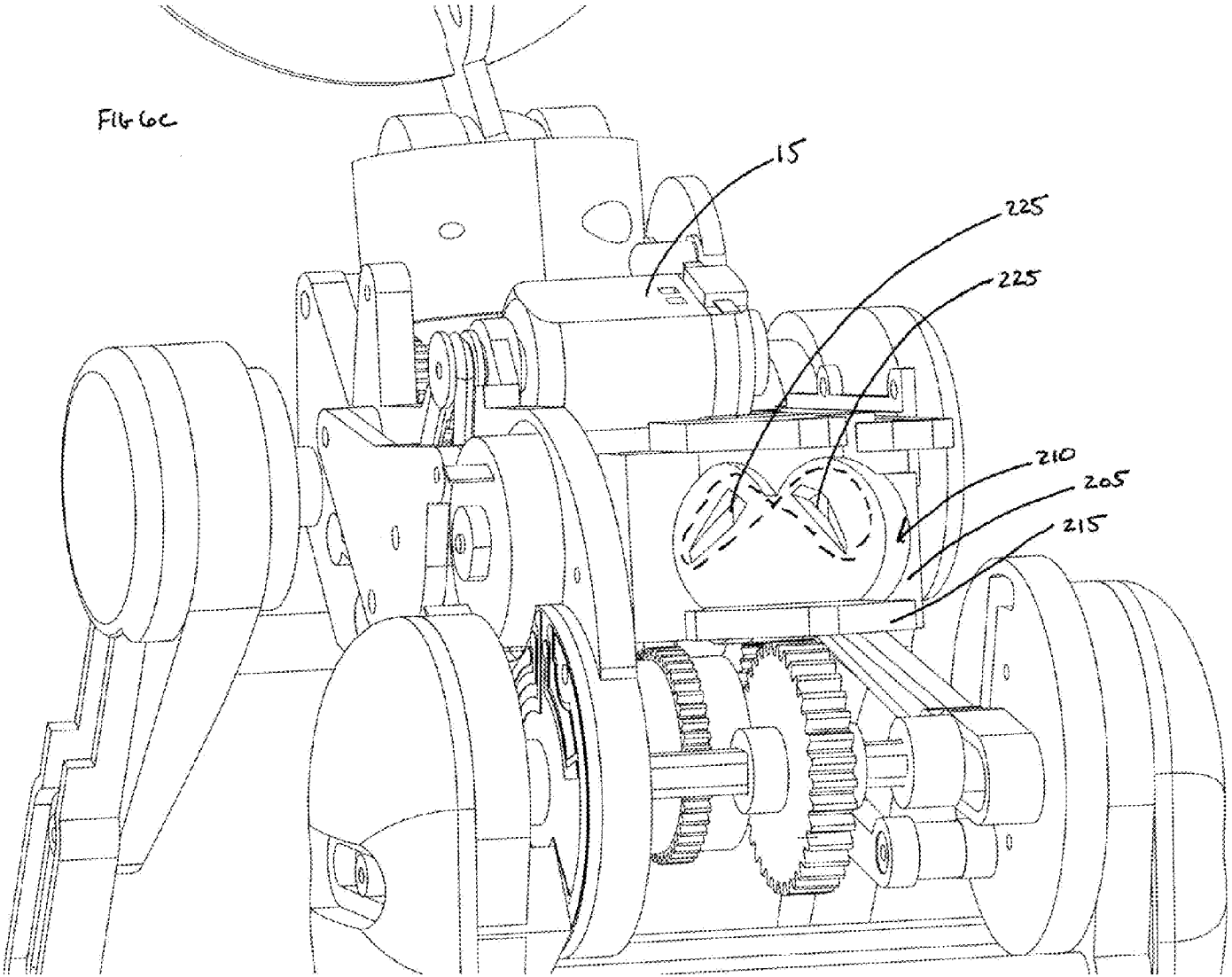
FIG. 6*c* is a rear perspective view the figure from FIG. 1 where a portion of the tail mechanism is removed.

Another example of the movements executed by the FIG. 10 includes the use of a tail mechanism as illustrated in FIGS. 6*a*-6*c*. The first motor 15 also drives the movement of a tail mechanism when the first motor 15 is powered in a counterclockwise direction. The belt drive 75 rotates a tail gear 145 which in turn drives the clutch gear 60 and engages the tail clutch 70. The tail clutch 70 is meshed to a bevel gear 150 fixed to a tail cam 155. A pin 160 is positioned on the upper side of the tail cam 155 and positioned in a forward linkage channel 165 at the forward portion of a tail linkage 170. The rear portion of the tail linkage 170 includes a rear linkage channel 175 to receive a pin 180 on a tail transfer segment 185 included in the tail mechanism. The tail mechanism further includes a tail column 190, a tail segment 195, a tail segment pin 200 and an actuator 205 with a heart-shaped cutout 210. The tail transfer segment 185 is fixed to the upper portion of the tail column 190 while the base of the tail column 190 is rotatably attached to a ledge 215 extending from the actuator 205 and rotates freely. The tail segment 195 is pivotally attached to the tail column 190 via a pin 220. The tail segment pin 200 extends from one end of the tail segment 195 such that it is positioned within the cutout 210. As movement is transferred to the tail mechanism via the tail linkage 170, the tail column 190 and tail segment 195 move in a pattern directed by the path the tail segment pin 200 travels. As the tail mechanism moves, the tail segment pin 200 travels along the outer rim of the cutout 210, then is pushed to the other side of the cutout 210 when the tail segment pin 200 encounters one of two flanges 225 extruding form the base of the cutout 210. Thus, the tail segment pin 200 travels in a figure eight type (shown with dotted lines in FIG. 6*c*) path as the tail mechanism moves. As such, by powering the first motor in the counterclockwise direction, power and rotation is transferred to the tail mechanism to create a movement similar to that of a "wagging tail." Further, the figure eight type path directs a movement that is a more fluid motion in comparison to a rigid mechanical movement.

Figure 7A:
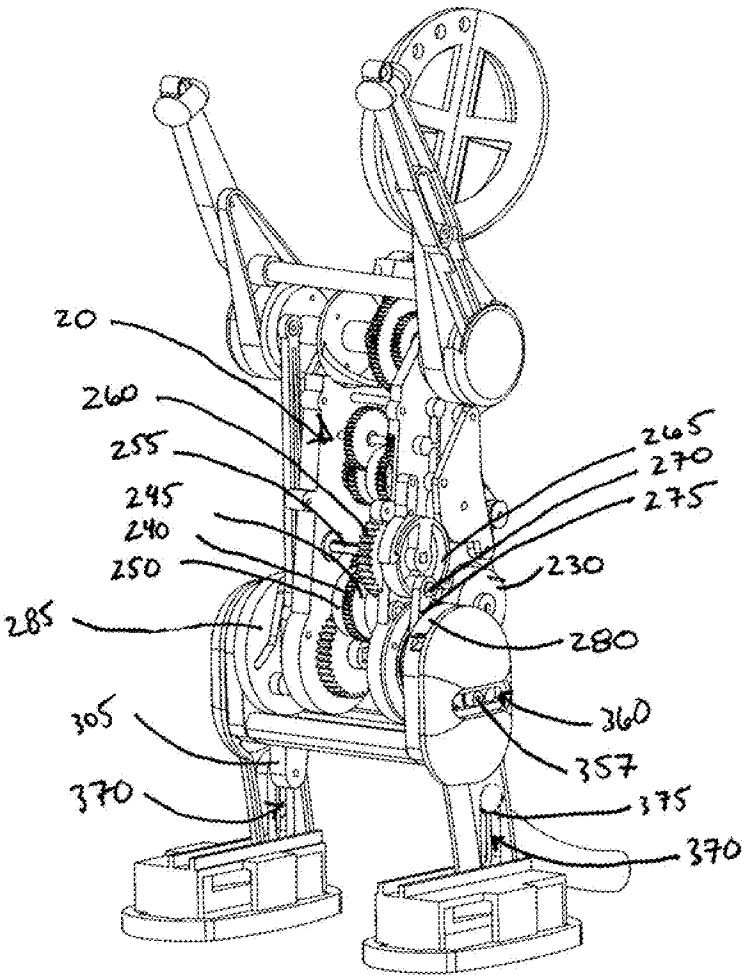
FIG. 7*a* is a front perspective view of the figure from FIG. 1 illustrating the figure in an upright position.
Figure 7B:
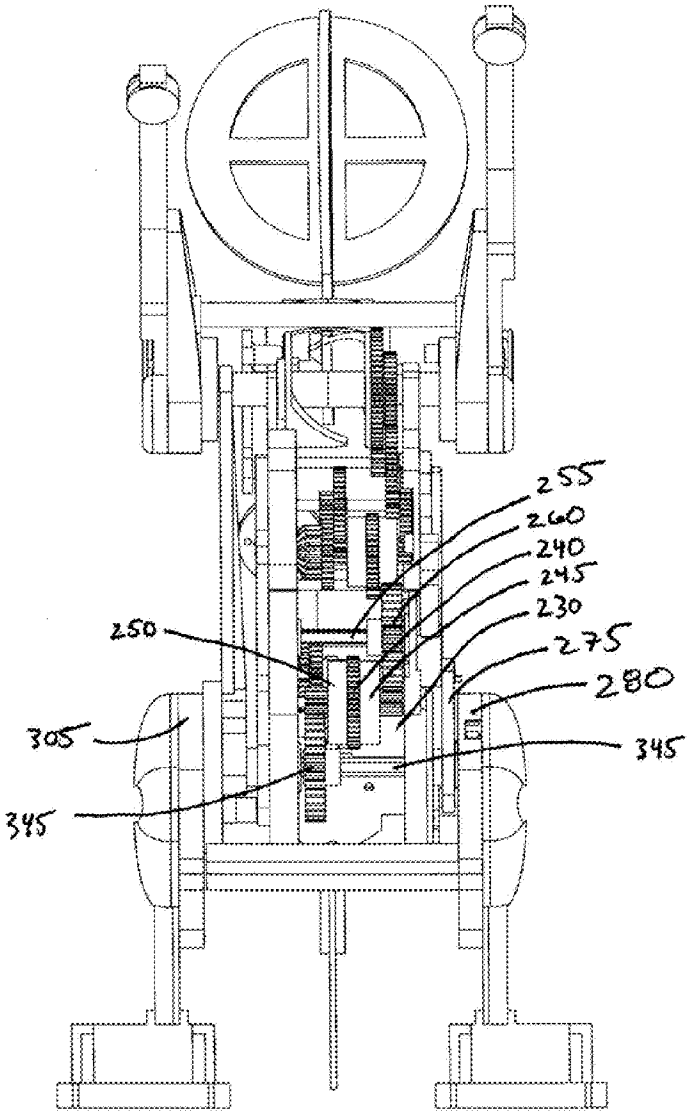
FIG. 7*b* is a front view of FIG. 7*a;*
Figure 7C:
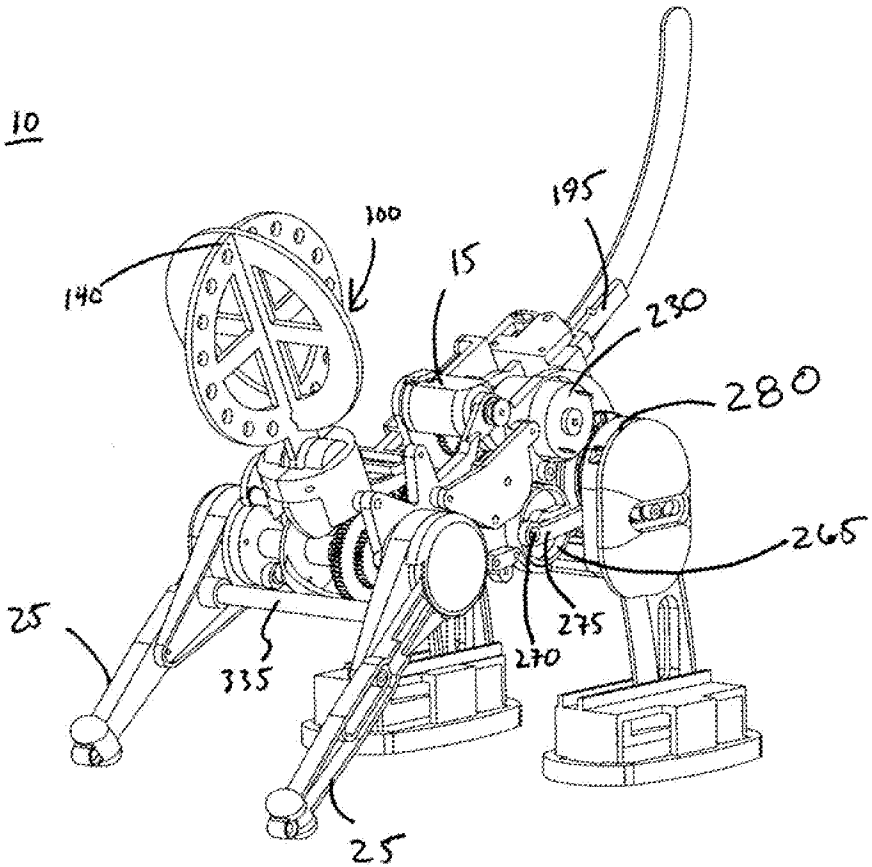
FIG. 7*c* is a front perspective view of the figure from FIG. 1 illustrating the figure in a lowered position.

An additional example of a movement of the FIG. 10 where the FIG. 10 moves from a sitting position (FIG. 1) to substantially an upright position (FIGS. 7*a* and 7*b*), however, it is within the scope to bring the FIG. 10 to an angled position above the horizontal. A second motor 230 is secured to the chassis 20. The second motor 230 has a motor gear 235 meshed to a clutch gear 240 fixed to an up clutch 245 and a bounce clutch 250. When the second motor 230 is powered in a clockwise direction, the up clutch 245 engages and transfers rotation to a mid axle 255 with a transfer gear 260 and an up cam 265 fixedly attached thereto. A pin 270 is positioned on the outside of the up cam 265 and is rotatably attached to an up linkage 275. The opposite end of the up linkage 275 is rotatably attached to a left hip 280. When the mid axle 255 rotates as directed by the second motor 230, the up cam 265 rotates therewith. The rotatable connection between the up linkage 275 and the up cam 265 drives the chassis 20 upward to an upright position. Continuing to power the second motor 230 and subsequently the rotation of the up cam 265 will further drive the chassis to a lowered position as seen in FIG. 7*c*. One full revolution of the up cam 265 will drive the chassis from the sitting position, then to the upright position, then to the lowered position and then back to the sitting position.

Further, adjusting the power distribution to the motor when the figure is in the sitting position provides for additional movement utilizing the mechanisms described above to raise the figure to the aforementioned upright or angled position. For example, a "pouncing" movement utilizes the weight and center of gravity of the figure along with a timing sequence related to the power distribution to the second motor. A switch is positioned such that it triggers in a range where the weight of the chassis causes the figure to lean slightly forward, generally in a range where the chassis is raised halfway to the full upright position. Triggering this switch pauses the application of power to the motor, providing time for the figure to lean forward. Power is then reapplied to continue extending the chassis as the figure leans forward, such that the figure then lies flat on a surface. Continuing to apply power to the motor will return the figure to the sitting position.

Figure 8A:
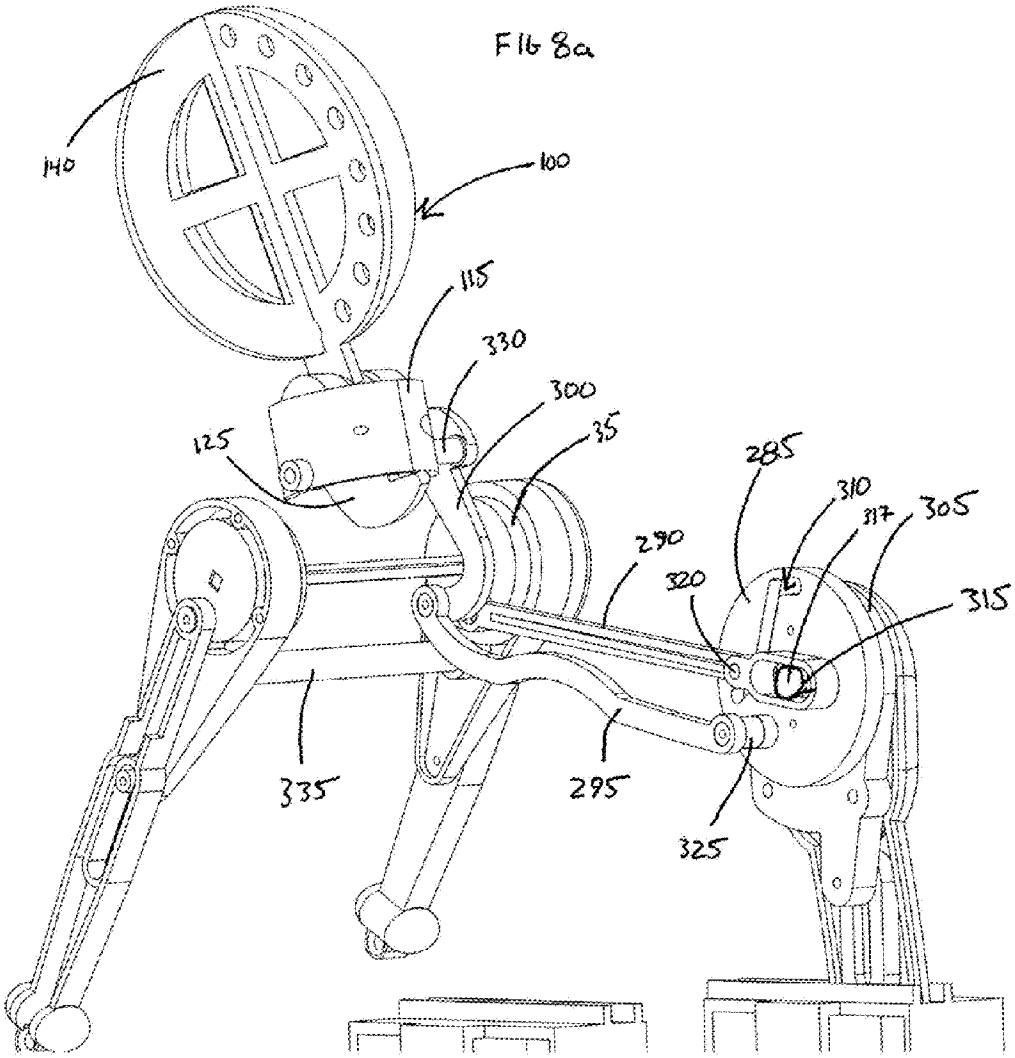
FIG. 8*a* is an enlarged rear perspective view of the figure from FIG. 1 where a portion of the figure is removed to show internal components of the figure where the figure is in a sitting position.
Figure 8B:
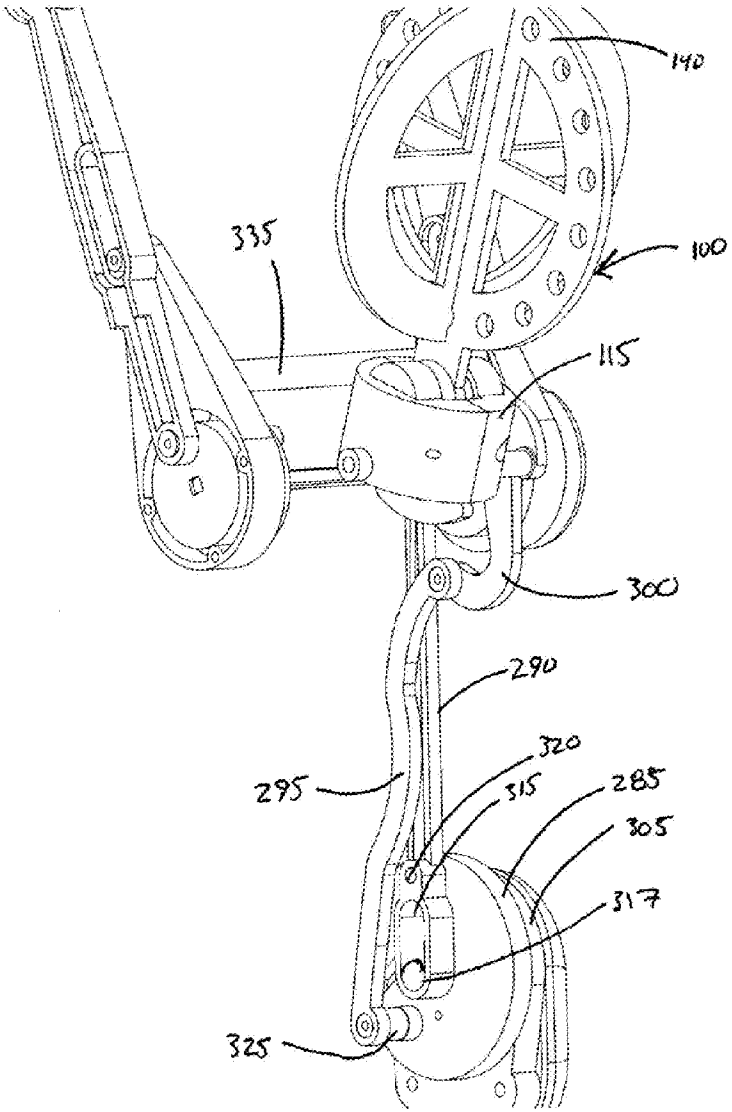
FIG. 8*b* is an enlarged rear perspective view of the figure from FIG. 1 where a portion of the figure is removed to show internal components of the figure where the figure is in an upright position.
Figure 8C:
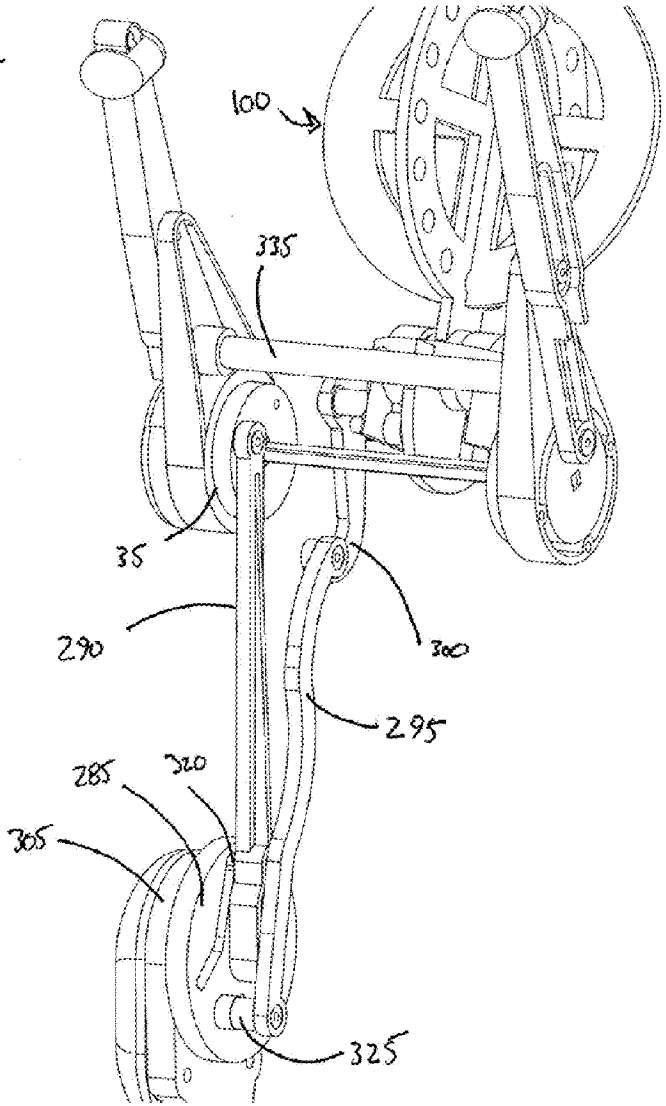
FIG. 8*c* is a front perspective view of FIG. 8*b;*

As the second motor 230 is powered in the clockwise direction and is raising the chassis 20, a second head mechanism additionally directs movement of the first head mechanism and the arm mechanism as illustrated in FIGS. 8*a*-8*c*. The second head mechanism includes a hip disc 285, a first linkage 290, a second linkage 295 and third linkage 300. The hip disc 285 is secured to a right hip 305 and includes a hip channel 310 and two pins positioned on the inside of the hip disc 285. The first linkage 290 has a first linkage channel 315 at one end to receive a pin 317 fixed to the hip disc 285. A pin 320 is positioned just up from the first linkage channel 315 and is positioned in hip channel 310. The other end of first linkage 290 is rotatably attached to the inner side of the right shoulder cam 35. One end of the second linkage 295 is rotatably attached to the hip disc 285 via a pin 325. The other end of the second linkage 295 is rotatably attached to the third linkage 300. The third linkage 300 is in rotatable communication with the first head mechanism via a head axle 330. As the chassis 20 rotates upward, the hip channel 310 guides the movement of the first linkage 290 as pin 320 travels along the hip channel 310, which in turn drives the right arm mechanism upward. An arm shaft 335 directs the left arm mechanism to move up simultaneously such that both arms are now in a raised position as seen in FIGS. 7*a* and 7*b*. The second linkage 295 moves along with the first linkage 290 and directs the third linkage 300 to rotate the head axle 330 forward and thus rotate the first head mechanism forward with the chassis 20 in the upright position.

It should also be known that while the chassis 20 and first head mechanism are in the upright position, powering the first motor 15 in the clockwise direction directs the arm mechanisms to activate and move the arms up and down as described above. Further, powering the first motor 15 in the counterclockwise direction, while the FIG. 10 is in the upright position, directs the tail mechanism to activate and wag as described above.

Figure 9:
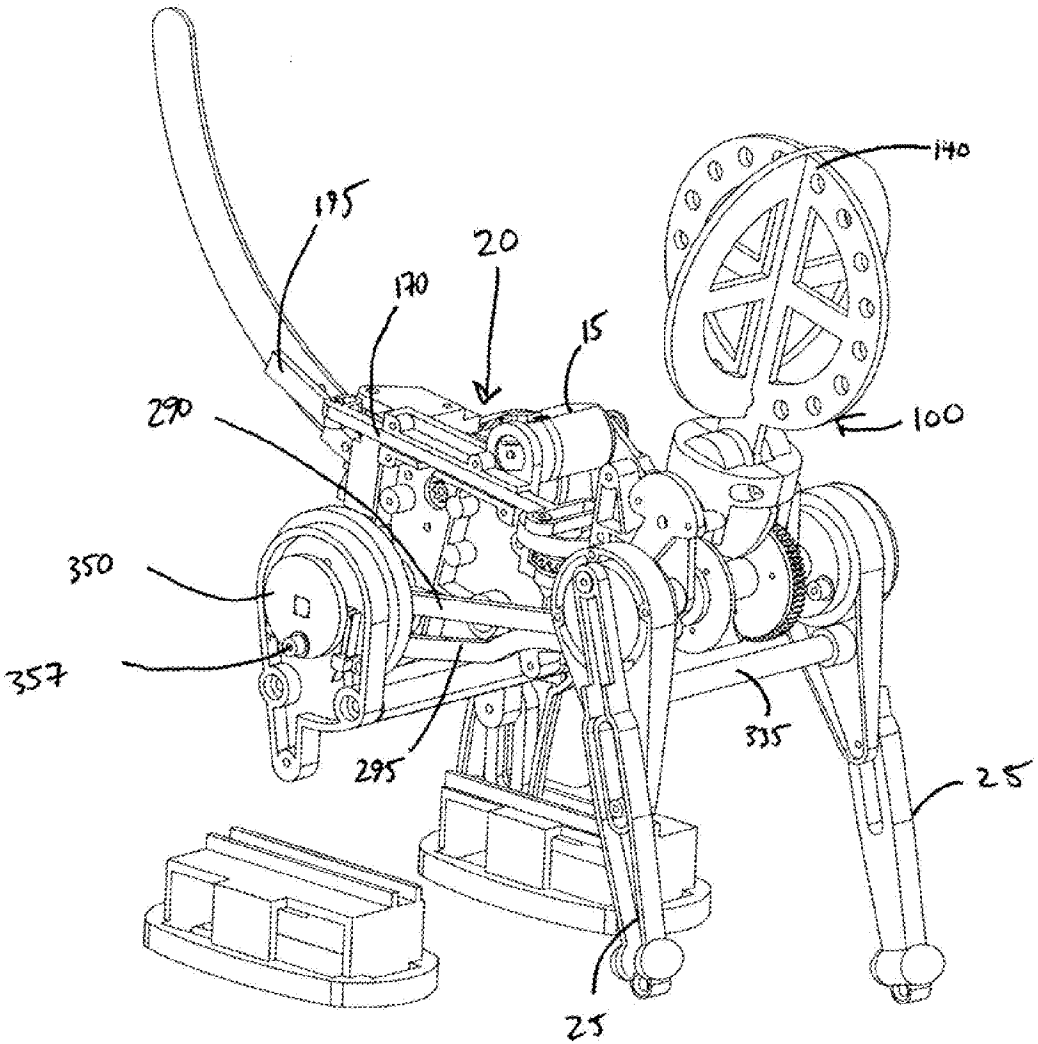
FIG. 9 is a front left perspective view of the figure from FIG. 1 where a portion of the figure is removed to show internal components.

Referring again to FIGS. 7*a* and 7*b* and now additionally FIG. 9, the second motor 230 also powers an up and down movement of the chassis 20 when the chassis 20 is in the upright position. When the second motor 230 is powered in the counterclockwise direction, the clutch gear 240 rotates and engages the bounce clutch 250 which is meshed to a rear axle gear 340 fixed to a rear axle 345. A right hip cam 350 and a left hip cam (not shown) are rotatably attached at either end of the rear axle 345. A pin 357 is positioned on the outside of both the left hip cam 355 and the right hip cam 350. Each pin is positioned in an upper leg channel 360 included in two legs 365 fixed to the left hip 280 and the right hip 305, respectively. The lower portion of each leg 365 includes a lower leg channel 370 to receive pins 375 positioned at the base of each hip. When rotation is transferred to the left hip cam 355 and right hip cam 350, the chassis 20 moves up and down as the pins 357 travel in the upper leg channels 360 while the pins 375 travel up and down in the lower leg channels 370. As such, when the second motor 230 is powered in the counterclockwise direction, the chassis 20 moves up and down in a bouncing type motion. It should be noted that varying the degree positioning of the pins 357 on the left hip cam 355 and right hip cam 350 can create a chassis motion that is more fluid and less rigid.

In the first embodiment, the FIG. 10 includes a means to move from a sitting position to an upright position in accordance to a variety of preprogrammed responses triggered by switches or user input.

Further and in accordance with the first embodiment, the FIG. 10 includes a means to move from an upright position to a lying down position in accordance to a variety of preprogrammed responses triggered by switches or user input.

The first embodiment also includes a means for the FIG. 10 to "pounce" from a sitting or upright position to a lying down position in accordance to a variety of preprogrammed responses triggered by switches or user input.

Additionally, the first embodiment includes a means to "wag" the tail of the FIG. 10 in accordance to a variety of preprogrammed responses triggered by switches or user input.

Also, the first embodiment includes a means to move the head and arms of the FIG. 10 in accordance to a variety of preprogrammed responses triggered by switches or user input.

Further, the first embodiment includes a means for the FIG. 10 to move up and down in a "bouncing" type motion while in an upright position in accordance to a variety of preprogrammed responses triggered by switches or user input.

Additionally, the first embodiment includes a means for the FIG. 10 to "pounce" and wag the tail of the FIG. 10 in accordance to a variety of preprogrammed responses triggered by switches or user input.

Also, the first embodiment includes a means for the FIG. 10 to "pounce" and move the head and arms of the FIG. 10 in accordance to a variety of preprogrammed responses triggered by switches or user input.

Further, the first embodiment includes a means for the FIG. 10 to move up and down in a "bouncing" type motion while the tail of the figure "wags" in accordance to a variety of preprogrammed responses triggered by switches or user input.

Additionally, the first embodiment includes a means for the FIG. 10 to move up and down in a "bouncing" type motion while moving the head and arms of the FIG. 10 in accordance to a variety of preprogrammed response triggered by switches or user input.

As mentioned above, the FIG. 10 executes a variety of movements and actions by alternating the direction to which each motor is powered. Further, different combinations of directional powering are available to create additional movements. The options for additional movements are increased when different amounts of power are distributed to the motors in addition to varying the direction. Each of the various movements may be triggered by several different control systems. For example, switches can be positioned throughout the figure to activate preprogrammed responses contained in an integrated circuit when triggered, such as when a user presses the head of the FIG. 10. Another example of a control system is the inclusion of a microphone in the FIG. 10 that activates preprogrammed responses contained in an integrated circuit when the microphone picks up certain audio signals. Yet another example is the use of remote control, where a user would input commands to a controller with a transmitter, and a receiver receives these commands and transfers the commands to an integrated circuit to direct movement of the FIG. 10.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or inferred.

We claim:

1. An interactive figure comprising:

a chassis having a front portion and a rear portion with a front pair of legs and a rear pair of legs rotatably attached to their respective portions;

a chassis mechanism secured to the figure and meshed to a chassis motor such that the chassis motor is configured to rotate the chassis about an upper portion of the rear legs;

the chassis mechanism further includes a reciprocating mechanism to repeat a sequence of movements;

a center of gravity defined by the figure;

a control system with an integrated circuit in communication with the chassis motor, the control system having preprogrammed responses stored therein;

a means for activating the preprogrammed responses, said preprogrammed responses being configured to control the chassis motor to move the figure through a plurality of positions, and wherein the plurality of positions include:

(a) a sitting position defined as a position where the front legs and rear legs are in communication with a surface and substantially perpendicular thereto;

(b) an angled position defined as a position above horizontal such that the center of gravity of the figure specifically causes the figure to lean forward on the rear legs and begin to fall forward;

at least one sensor in communication with the integrated circuit, the sensor being in a predetermined position to detect and send a signal to the integrated circuit when the chassis mechanism rotates the front portion of the chassis to the angled position; and said preprogrammed responses configured to activate the chassis motor in a first direction to rotate the chassis mechanism in accordance with the reciprocating mechanism through the sequence of movements including a pouncing movement, wherein the pouncing movement is further defined by the preprogrammed responses:

(i) being configured to move the figure to the angled position from the sitting position, (ii) being further configured to pause rotation of the chassis for a first time period defined when the integrated circuit receives the signal from the sensor identifying the angled position where the figure's center of gravity position causes the figure to begin falling forward, (iii) being further configured to activate the chassis motor in the first direction to continue rotating the front portion upward relative to the upper portion of the rear legs, (iv) and yet further configured to continue rotating the front portion of the chassis as the reciprocating mechanism directs the chassis mechanism to return the figure to the sitting position, thereby completing the pouncing movement.

2. The interactive figure of claim 1 wherein when the figure begins to fall forward, the preprogrammed responses are further configured to drive the chassis motor at a first speed when activating the chassis motor in the first direction to continue rotating the front portion upward relative to the upper portion of the rear legs.

3. The interactive figure of claim 2, the plurality of positions further including a lie flat position defined by having an underside portion of the chassis facing the surface and such that the front portion of the chassis rotates to substantially a linear alignment with the rear legs;

wherein when the figure begins to fall forward, the preprogrammed responses are further configured to drive the chassis motor at a second speed when activating the chassis motor in the first direction to continue rotating the front portion upward relative to the upper portion of the rear legs, the second speed defined as a speed slower than the first speed such that the figure falls to the lie flat position.

4. The interactive figure of claim 2, wherein the first animation movement is further defined as a bouncing movement where the first animation mechanism includes a means to oscillate the chassis up and down on the rear legs when the figure is in an upright position further defined as a position where the front portion of the chassis is rotated to substantially an upright position and only the rear legs are in communication with the surface.

5. The interactive figure of claim 1, the interactive figure further comprising:

a first animation mechanism in communication with the chassis motor such that the first animation mechanism activates when the chassis motor is powered in a second direction;

a first animation movement directed by the first animation mechanism; and wherein the preprogrammed responses are further configured to power the chassis motor in a second direction to activate the first animation movement in accordance with the first animation mechanism.

6. The interactive figure of claim 1, the interactive figure further comprising:

an appendage motor secured to the chassis and in communication with the integrated circuit;

a second animation mechanism in communication with the appendage motor to drive the second animation mechanism;

a plurality of animation movements directed by the second animation mechanism; and wherein the preprogrammed responses are further configured to power the appendage motor in a first direction to activate a second animation movement in accordance with the second animation mechanism.

7. The interactive figure of claim 6 wherein the preprogrammed responses are further configured to power the appendage motor in a second direction to activate a third animation movement in accordance with the animation mechanism.

8. An interactive figure comprising:

a chassis having a front portion and a rear portion with a front pair of legs and a rear pair of legs rotatably attached to their respective portions;

a chassis mechanism secured to the figure and meshed to a chassis motor such that the chassis motor is configured to rotate the chassis about an upper portion of the rear legs;

a center of gravity defined by the figure;

a control system with an integrated circuit in communication with the chassis motor, the control system having preprogrammed responses stored therein;

a means for activating the preprogrammed responses, said preprogrammed responses being configured to control the chassis motor to move the figure through a plurality of positions, and wherein the plurality of positions include:

(a) a sitting position defined as a position where the front legs and rear legs are in communication with a surface and substantially perpendicular thereto;

(b) an angled position defined as a position above horizontal such that the center of gravity of the figure specifically causes the figure to lean forward on the rear legs and begin to fall forward;

at least one sensor in communication with the integrated circuit, the sensor being in a predetermined position to detect and send a signal to the integrated circuit when the chassis mechanism rotates the front portion of the chassis to the angled position; and said preprogrammed responses configured to activate the chassis motor to rotate the chassis mechanism in accordance with a rotation sequence further defined as a pouncing movement by (i) being configured to move the figure to the angled position from the sitting position by activating the chassis motor in a first direction, (ii) being further configured to pause rotation of the chassis for a first time period defined when the integrated circuit receives the signal from the sensor identifying the angled position where the figure's center of gravity position causes the figure to fall forward such that the front legs make contact with the surface, (iv) and yet further configured to reverse rotation of the front, portion of the chassis by activating the chassis motor in a second direction to return the figure to the sitting position, thereby completing the pouncing movement.

9. The interactive figure of claim 8, the plurality of positions further including a lie flat position defined by having an underside portion of the chassis facing the surface and such that the front portion of the chassis rotates to substantially a linear alignment with the rear legs;

wherein when the figure begins to fall forward, the preprogrammed responses are further configured to drive the chassis motor in the first direction to continue rotating the front portion upward relative to the upper portion of the rear legs such that the figure falls to the lie flat position.

10. The interactive figure of claim 8, the interactive figure further comprising:

an appendage motor secured to the chassis and in communication with the integrated circuit;

a second animation mechanism in communication with the appendage motor to drive the second animation mechanism;

a plurality of animation movements directed by the second animation mechanism; and wherein the preprogrammed responses are further configured to power the appendage motor in a first direction to activate a second animation movement in accordance with the second animation mechanism.

11. The interactive figure of claim 10, the second animation mechanism a means to extend and retract the front legs, and a means to move a head from side to side, further defining the second animation movement.

12. The interactive figure of claim 10 wherein the preprogrammed responses are further configured to power the appendage motor in a second direction to activate a third animation movement in accordance with the second animation mechanism.

13. The interactive figure of claim 12, the second animation mechanism including a means to move a tail to further define the third animation movement.

14. The interactive figure of claim 8, the figure further including a third animation mechanism with a means to raise and lower the front legs, and means to raise and lower a head; and the third animation mechanism in communication with the chassis mechanism such that the third animation mechanism rotates in accordance with movement of the chassis mechanism, wherein activating the chassis mechanism directs the third animation mechanism to raise and lower the front legs and head in accordance thereto.

15. An interactive figure comprising:

a chassis having a front portion and a rear portion with a pair of front legs and rear legs rotatably attached to their respective portions;

a chassis mechanism secured to the figure and meshed to a chassis motor such that the chassis motor is configured to rotate the chassis about an upper portion of the rear legs;

a center of gravity defined by the figure;

the chassis mechanism further including a reciprocating mechanism to repeat a sequence of movements through a plurality of positions and a means to activate the same;

wherein the plurality of positions include:

(a) a sitting position defined as a position where the front legs and rear legs are in communication with a surface and substantially perpendicular thereto;

(b) an angled position defined as a position above horizontal;

the chassis motor including a first speed defined as a constant speed where the center of gravity of the figure specifically causes the figure to lean forward on the rear legs and begin to fall forward when the figure is in the angled position;

a control system with an integrated circuit in communication with the chassis motor and an appendage motor, the control system having preprogrammed responses stored therein, said preprogrammed responses being configured to activate a plurality of animation mechanisms including a second animation mechanism when the figure is in the plurality of positions to direct the figure to execute a plurality of animation movements;

the preprogrammed responses further configured to activate the chassis motor at the first speed to rotate the chassis mechanism in accordance with the reciprocating mechanism through the sequence of movements including a pouncing movement, wherein the pouncing movement is further defined by the chassis mechanism:

(i) being configured to move the figure to the angled position from the sitting position causing the figure to begin falling forward, (ii) being further configured to continue rotating the front portion of the chassis upward relative to the upper portion of the rear legs, (iii) and yet further configured to continue rotating the front portion of the chassis as the reciprocating mechanism directs the chassis mechanism to return the figure to the sitting position, thereby completing the pouncing movement;

the second animation mechanism in communication with the appendage motor to drive the second animation mechanism and move the figure through a plurality of animation movements including a second animation movement; and wherein the preprogrammed responses are further configured to power the appendage motor in a first direction to activate the second animation movement in accordance with the second animation mechanism.

16. The interactive figure of claim 15 further comprising:

at least an upright sensor in communication with the integrated circuit, the upright sensor being in a predetermined position to detect and send a signal to the integrated circuit when the chassis mechanism rotates the front portion of the chassis to an upright position, the upright position further defined as a position where the front portion of the chassis is rotated to substantially an upright position and only the rear legs are in communication with the surface;

wherein the preprogrammed responses further configured to activate the appendage motor in a second direction to direct a first animation movement when the figure is in the upright position, the first animation movement further defined as a bouncing movement, wherein the first animation mechanism includes a means to oscillate the chassis up and down on the rear legs when the figure is in an upright position.

17. The interactive figure of claim 15, the second animation mechanism further including a means to extend and retract the front legs, and a means to move a head from side to side, further defining the second animation movement.

18. The interactive figure of claim 15, wherein the preprogrammed responses are further configured to power the appendage motor in a second direction to activate a third animation movement in accordance with the second animation mechanism.

19. The interactive figure of claim 18, the second animation mechanism further including a means to move a tail, further defining the third animation movement.

20. The interactive figure of claim 15, the figure further including a third animation mechanism with a means to raise and lower the front legs, and a means to raise and lower a head; and the third animation mechanism in communication with the chassis mechanism such that the third animation mechanism rotates in accordance with movement of the chassis mechanism, wherein activating the chassis mechanism directs the third animation mechanism to raise and lower the front legs and head in accordance thereto.

* * * * *